United States Patent [19]

Gow

[11] Patent Number: 4,513,546

[45] Date of Patent: Apr. 30, 1985

[54] CORNER KEY FOR WINDOW SPACER ELEMENT

[75] Inventor: Robert J. Gow, Granville, N.Y.

[73] Assignee: Norton Company, Worcester, Mass.

[21] Appl. No.: 129,568

[22] Filed: Mar. 12, 1980

[51] Int. Cl.[3] ..... E06B 7/12; E04C 2/38

[52] U.S. Cl. ..... 52/172; 52/656

[58] Field of Search ..... 52/656–658, 52/172, 788–790; 403/231, 401, 402

[56] References Cited

U.S. PATENT DOCUMENTS

| | | | |
|---|---|---|---|
| 1,975,895 | 9/1934 | Geyer . | |
| 2,989,788 | 6/1971 | Kessler | 52/656 |
| 3,304,108 | 2/1967 | Hamilton et al. | 52/656 |
| 3,553,913 | 1/1971 | Eisenberg | 52/172 |
| 3,606,419 | 9/1971 | Virkler et al. | 160/381 |
| 3,782,054 | 1/1974 | Goss | 52/656 |
| 3,949,526 | 4/1976 | Sherlock et al. | 49/501 |
| 4,011,706 | 3/1977 | Dupree | 403/231 |
| 4,080,482 | 3/1978 | Lacombe . | |
| 4,097,320 | 6/1978 | Brauer et al. | 52/304 |
| 4,110,148 | 8/1978 | Rochall . | |
| 4,183,693 | 1/1980 | Berdan | 52/788 |
| 4,222,209 | 9/1980 | Peterson | 52/172 |
| 4,268,553 | 5/1981 | Marzouki et al. | 52/790 |

*Primary Examiner*—James L. Ridgill, Jr.
*Attorney, Agent, or Firm*—Arthur A. Loiselle, Jr.

[57] ABSTRACT

A corner key device is shown for use in a glass thermal pane structure assembly, the key device is used with longitudinally extending spacer means that may be formed into a rectangular spacing frame to hold the several sheets of glass forming the pane separated. The corner key means is made in the shape of a straight channel adapted to be telescopically interfitted with the spacer means and this straight lineup of channel shaped corner and spacer elements may then be coated on the outside of their walls with a layer of a hot melt sealant. Then the corner key devices are then bent at right angles to produce the rectangular frame adapted to engage the glass sheets around their perimeter to produce a seal between the glass sheets and spacer means and bind them together to form the finished thermal pane. The corner key is initially formed as a straight channel element having notched side walls at about its midpoint so that after the spacers, keys and sealant are assembled and the keys are bent, the sealant applied to the sides of the assembled channel elements will flow together at the corners to complete a closed circle of sealant around both sides of the entire frame for sealing against the perimeter of the respective glass sheets.

8 Claims, 6 Drawing Figures

CORNER KEY FOR WINDOW SPACER ELEMENT

TECHNICAL FIELD

The invention relates to the insulated or thermal window and door technology. More particularly the invention relates to the corner key for joining spacer elements to form spacer frames which are used to space and assemble two or more sheets of glass.

BACKGROUND ART

It is well known that several sheets of glass may be mounted on means holding them in a spaced relationship to provide an insulated window pane. Representative structures of this kind are illustrated in the U.S. Pat. No. to Geyer, 1,975,895, Oct. 9, 1934 and Eisenberg, U.S. Pat. No. 3,553,913, Jan. 12, 1971. In the usual thermal pane construction, a rectangular frame constituting a spacer means is coated on its sides with a sealant and the sheets of glass are cemented to the spacer means sandwiched between the glass sheets to produce a thermal pane having dead air space between the sheets. A dessicant is usually carried in the spacer device to eliminate the condensation of any moisture on the glass, which moisture might have been trapped within the enclosed chamber.

To effect the assembly of such thermal panes, it has been the usual practice to provide aluminum channel spacer elements that are as long as each peripheral side of the glass sheets to be assembled and then weld the spacer elements together to form a rectangular spacer frame or by making use of corner key elements that have right angular shapes, as shown in Lacombe, U.S. Pat. No. 4,080,482, Mar. 21, 1978.

After the rectangular frame is put together, a sealant may be applied to the sides of the frame, requiring several manipulative steps to properly coat both walls of each side of the rectangular frames. While applying the sealant during this coating process, it is possible that the sealant will not be applied uniformly due to the necessity for shifting the square frame after each side is coated and also it is possible that foreign matter may contact the applied sealant as the frame is turned from side to side to complete the four-sided coating operation. Should any fingerprints or any foreign matter come in contact with the more or less sticky, hot melt sealant during these manipulations or if an uneven coating layer is applied to one or more of the respective walls of the four-sided frame caused by the shifting of the frame relative to the applicator, a proper seal could not be made and the resulting thermal pane will be defective.

DISCLOSURE OF THE INVENTION

To minimize the complications inherent in coating the respective side walls of a spacer frame, the present disclosure makes use of a novel corner key structure and method of assembling spacer elements together with corner key means to produce a spacer frame for supporting the glass sheets forming the thermal pane. The corner key of this invention is initially formed as a straight channel section having an enlarged central portion with two legs disposed 180° apart, several such keys being provided for telescopically fitting into the opposite ends of the separate spacer elements that are to be fitted to the glass sheets along each side of the perimeters of the sheets that constitute the completed pane.

The several spacer elements are fitted together with four corner keys to provide an elongated straight intermediate assembly of parts. At this stage of the operations, the two side walls of the straight elongated structure are coated with the hot melt sealant and preferably, immediately thereafter, the coated assembly is bent at each corner key to make a rectangular frame that may be fitted to the peripheral portions of the glass plates for completion of the assembly as typically illustrated, for example, in the patent to Rochall, U.S. Pat. No. 4,110,148 of Aug. 29, 1978.

The corner key construction of this invention is first manufactured as a straight channel element having a central portion with a crossectional shape, the same as the crossectional shape of the spacer bars. The center portion has two legs integral therewith of reduced crossectional size to telescopically interfit with the ends of the spacer elements to form a sub-assembly. The side walls of the center portion of each corner key element are both cutaway to provide V-slots with the bottom of the V's adjacent the floor of the channel. The arms of the V's are spread 90° apart and two legs extend outwardly from the central portion along center lines disposed 180° apart. Such a corner key structure permits the elements of the frame to be initially assembled to produce a straight line of parts that can be coated on each side with a sealant under the best possible of conditions. The coated line of elements can then be easily manipulated to bend each corner key at the bottom line of the V slots whereby to form a rectangular frame coated with a hot melt sealant, which frame is designed for incorporation between the sheets of glass forming the thermal pane. After the glass sheets and frame have been brought together, the thermal pane can be completed in a well known way by heating the resin sealant to activate the resin.

IN THE DRAWINGS

BEST MODE FOR CARRYING OUT THE INVENTION

Figures 1, 2, 3, 4, 5, 6:
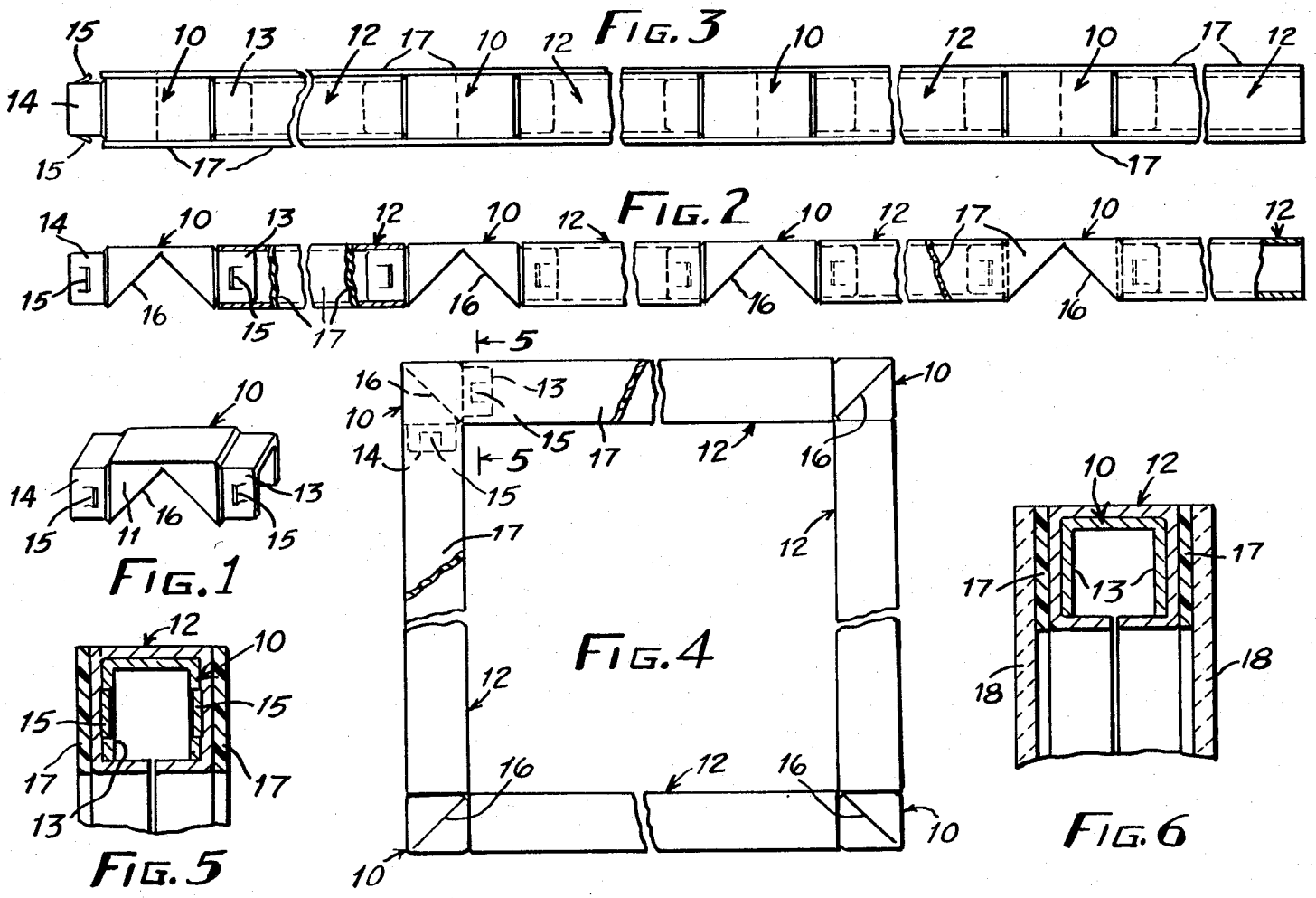
FIG. 1 is a perspective view of the corner key forming the subject of this invention.
FIG. 2 is a side view of several corner keys and spacer bar means assembled, partly broken away to show an interfitted leg and spacer and also the partial application of sealant over a corner key and spacer bar.
FIG. 3 is a top plan view of the assembly of FIG. 2, showing sealant applied along both side walls of the straight line assembly.
FIG. 4 shows the coated assembly formed into a rectangular frame.
FIG. 5 is a detail taken on line 5—5 of FIG. 4.
FIG. 6 is a broken away sectional view showing glass sheets assembled together with the frame, taken on line 5—5 of FIG. 4.

The essence of the corner key of this invention is best seen in FIG. 1. A channel shaped element 10 having an enlarged central portion 11 is preferably formed by a stamping operation. The key is adapted to be assembled with elongated spacer bars or elements 12 and the bars 12 are also channel shaped, having crossectional dimensions approximately the same as that of the center portion 11 of the corner key. The spacer bar 12 may be of a simple open U-shaped cross section but are preferably almost closed on all four sides except for a slight opening on the side that will form the inside surface of the completely assembled frame. This allows the element to be filled.with a dessicant. The corner key has. integral leg members 13 and 14 of reduced crossectional size extending outwardly therefrom along center lines that are spaced 180° apart. The legs are channel shaped also and are of a size to telescope neatly within the ends of the respective spacer bars 12, as shown in FIGS. 2–5. The legs are preferably provided with outwardly pressed spring barbs 15 to hold the corner keys locked in position after the parts have been assembled with the spacer bars 12, but any conventional locking means can be provided for this purpose.

The side walls of the channel forming the center portion 10 are each provided with V-shaped notches 16. The bottom of each such V slot is positioned approximately at the bottom wall of the channel and the arms of the V are preferably spread apart about 90°. This channel shaped stamped corner key element is designed to provide keys 10 that can be easily, yet firmly, assembled with the spacer bars 12 to form a straight and relatively rigid channel structure which constitutes an intermediate frame means that is now ready for the application of sealant layers to the outer sides of the channel walls.

The assembled corner keys and spacer bar means are then coated on two or three sides with a hot melt sealant such as extruded or trowelled on butyl rubber based sealant or other well known hot melt sealants based on polysulfide, polyamide, or the like. The sealant forms a layer 17 on the side walls of the straight line of channel shaped assembled elements, as best seen broken away in FIG. 2 and coating the entire length of the side walls, as shown in FIG. 3. The composite sealant and channel structure is then ready to be formed into a rectangular spacer frame, as shown in FIG. 4, by bending the corner key members 10 to close the V slots 16. Such a bending step can be easily accomplished in mechanized means forming no part of this invention and when the bending steps at each corner have been completed and the legs 13 and 14 all telescopically fitted into the respective ends of the spacer bars 12, the sealant layer 17, that has been deposited on each of the side walls of the corner keys 10, flows together to provide a unitary layer of sealant as wide as the sides of the channel walls that completely encircles the spacer frame on both sides of the corner keys and spacer bars.

At this stage the completed frame having the hot melt sealant on its sides, is ready to be assembled with the glass sheets that ultimately form the thermal pane. As seen in FIG. 6, the spacer bar 12, having the sealant layers 17 on its side walls, is positioned adjacent the peripheries of the two spaced apart sheets of glass 18. An additional spacer frame and a third layer of glass could be provided if desired and then the assembled glass sheets and spacer frames may be subjected to apparatus for activating the sealant. If deemed necessary, an additional band of sealant may be disposed around the outer periphery of the assembled parts integral with the thermal pane as shown, for example, in the Rochall, U.S. Pat. No. 4,110,148, mentioned above.

As is well known, a suitable dessicant material may be provided within the spacer frame elements. Also spacer frame shapes other than rectangular may be provided with a proper selection for the angular opening of the arms 16 forming the edges of the V slots in each of the corner key members.

Suitable known extrusion or trowelling type sealant application means for laying the hot melt sealant 17 on the sides of the straight line channel assembly of FIGS. 2 and 3 may be provided. The intermediate assembly of straight line corner keys 10 and spacer bars or elements of FIGS. 2 and 3 permits the use of a much simpler sealant application procedure, which may be mechanized. This simplification of the sealant application step as compared with the problems of applying sealant layers to the two sides of a completely formed rectangular or other shape of spacer frame, minimizes the manipulative steps and consequently eliminates the chance for inadvertent damage to the intermediate coated frame structure.

Since the hot melt sealant flows somewhat, the present corner key structure permits the application of the sealant to take place with a single stroke on each side of the assembled parts at the intermediate stage of forming a frame, including coating both sides of the center portion of the corner key having the V slots therein, and after the sealant has been applied, the assembly is bent at the corner key means to complete the frame and after bending the corner keys to close the V slots, the sealant flows together to complete a solid seal ring on the frame. Such a method of assembling and forming the spacer frame minimizes the possibility of picking up particles on the applied sealant or getting fingerprints or the like on it, which foreign substances might interfere with completion of a perfect seal between the sealant, the frame and the glass sheets.

Due to the flexability of the elements of the frame and the tolerances required in making the completed assembly, the simple act of bending the assembled and sealant coated frame device at the corner keys and completing the interfit of the elements forming the rectangular frame assembly can be accomplished in a mechanized unit. With a properly designed mechanical unit, it is possible to insure a clean assembly of the sealant coated frame and the glass sheets that can be delivered untouched by human hands to a heating and pressing station in order to complete a more perfect seal. As soon as the bending operation is completed as stated above, the sealant coated on the side walls of the corner keys tends to flow together and upon performance of the subsequent heating and pressing steps, the rings of sealant between the glass sheets and the sides of the frame are integrated to form a solid layer of sealant where the V gaps formerly existed so that a completely and more perfectly sealed assembly of a thermal pane window results.

This basic assembly may be further sealed with the application of an additional band of the same or a different kind of sealant applied over the spacer frame and around the periphery of the assembly, if desired. Also a protective metal frame may be added to cover the outer periphery of this completed thermal pane sub-assembly.

The spacer bars and corner keys are preferably formed of stamped aluminum metal but any easily bendable material may be used for forming the frame elements as, for example, other metals or plastic materials could be used interchangeably. Preferably, a material having the same or nearly the same coefficient of expansion as the glass sheets should be used to minimize the build-up of stresses in the seal when the finished pane is subjected to different temperature conditions.

The preferred crossectional shape of the corner keys and spacer bars is the channel section. This provides the simplest support for the sealant around the walls of the spacer frame when it is assembled with the glass sheets. Any other crossectional shape can be used, however, that provides side wall support for the sealant entirely around the periphery of the frame and permits the bending of the V provided in the center portion of the corner keys to complete the frame after the sealant has been applied thereto.

The preferred form of this invention has been described herein, it is possible that modifications thereof may occur to those skilled in the art that will fall within the scope of the following claims.

What is claimed is:

1. A corner key means for use with hollow elongated spacer elements and a hot melt sealant to form a frame adapted to be used in the assembly of sheets of glass to form a thermal pane, each key comprising an enlarged body member of fixed length having a bottom and oppositely disposed side walls, a V-shaped notch extending from one side to the other through the body, said notch being positioned about midway of the length of said key with a line connecting the bottom of the V on each side wall lying over the bottom wall of said body member, leg members of a size slightly smaller than said body member integral with said body member, said slightly smaller sized leg members each extending outwardly from the opposite ends of the body and having a crossectional shape to telescopically interfit in the ends of the hollow elongated spacer elements, and a layer of hot melt sealant applied to at least two of the side walls of said key and the spacer elements with which it is assembled, whereby when a plurality of said key means and spacer elements are assembled and coated with sealant, the assembly can then be bent on each of said lines across the bottom of said body members to close said V slots to produce a closed frame with a ring of sealant on at least two sides thereof for assembly with sheets of glass to be sealed thereto to form a thermal pane.

2. A structure as in claim 1 wherein said body member and its integral leg members are of channel crossectional shape.

3. A structure as in claims 1 or 2 wherein the sloping sides of said V-shaped notch are disposed at a 90° angle with respect to each other.

4. A structure as in claims 1 or 2 wherein locking means are provided to interact between said legs and said spacer elements to hold the assembly together.

5. A structure as in claims 1 or 2 wherein a hot melt sealant is used that flows across from one sloping wall of said V slot to the other of such sloping walls when the body member is bent to close said V.

6. A corner key means for use with hollow elongated spacer elements of rectangular crossection and a hot melt sealant to form a frame adapted to be used in the assembly of sheets of glass to form a thermal pane for use in a window, each key comprising a channel shaped key member of fixed length from end to end, said key having an enlarged body portion with integral leg means, said channel shape having a floor surface and two integral side walls, a V-shaped notch in each of the side walls of the body portion of said key member, said notches being positioned approximately midway of the length of said key member with the bottom of the V's disposed at the ends of a line over the floor of said channel shape, said leg means being disposed at the opposite ends of said key member and having a crossection shape of a size to telescopically fit snugly within one end each of a pair of spacer elements, locking means to fixedly secure each of said leg means of the key means in the respective ends of said spacer means into which it is telescopically fitted, and a layer of hot melt sealant applied to the outside walls of said assembled corner key and spacer elements whereby when a plurality of said key means and spacer elements are assembled and coated with sealant, the assembly can be bent on said lines that lie over the floor of said channel shape to form a closed frame with a ring of sealant on each side for assembly with sheets of glass to fit entirely around the periphery of said glass sheets to be bonded thereto to hold the sheets in spaced relation with the space between said sheets hermetically sealed to form a thermal pane, and wherein said spacer elements contain a dessicant.

7. A method of preparing a spacer frame for assembly with sheets of glass to form a thermal pane comprising assembling a plurality of straight channel shaped corner key means and spacer bars to form an elongated straight intermediate assembly of elements, applying hot melt sealant to at least two of the side walls of said intermediate assembly, bending said corner keys to form the spacer bars and corner keys into a closed frame, and then assembling the frame and sheets of glass and activating the sealant to form a thermal pane.

8. A method as in claim 7 wherein said sealant is permitted to flow on the side wall surfaces of said frame after the key means are bent and the bars and corner keys are formed into a closed frame to form an integrated band of sealant on the side walls thereof.

* * * * *

Notice of Adverse Decision in Interference

In Interference No. 102,135, involving Patent No. 4,513,546, R. J. Gow, CORNER KEY FOR WINDOW SPACER ELEMENT, final judgement adverse to the patentee was rendered Dec. 4, 1990, as to claims 1-8.

(*Official Gazette March 5, 1991*)